United States Patent [19]

Bar

[11] 4,449,610

[45] May 22, 1984

[54] MUFFLER FOR COMPRESSOR FOR REFRIGERATING APPARATUSES

[75] Inventor: Alfredo Bar, Pavia, Italy

[73] Assignee: Necchi Societa per Azioni, Pavia, Italy

[21] Appl. No.: 349,475

[22] Filed: Feb. 17, 1982

[30] Foreign Application Priority Data

Feb. 24, 1981 [IT] Italy ..... 42906 A/81

[51] Int. Cl.[3] ..... F01N 1/08; F01N 7/18; F25D 3/02

[52] U.S. Cl. ..... 181/243; 181/202; 181/246; 181/272; 181/403; 417/312; 62/296

[58] Field of Search ..... 181/202, 243, 246, 282, 181/272, 403; 417/312, 372, ; 62/296

[56] References Cited

U.S. PATENT DOCUMENTS 3,750,840 8/1973 Holme ..... 417/312 X 4,370,104 1/1983 Nelson et al. ..... 62/296 X

*Primary Examiner*—Benjamin R. Fuller

*Attorney, Agent, or Firm*—Stevens, Davis, Miller & Mosher

[57] ABSTRACT

A muffler on the intake tube in a hermetically sealed compressor for refrigerating apparatuses in direct communication with the intake chamber located in the compressor cylinder head. The body of the muffler, preferably made of plastic material, consists of two half-shells of identical form and structure assembled in an overlapped way and turned by 180° C. with respect to each other.

2 Claims, 2 Drawing Figures

MUFFLER FOR COMPRESSOR FOR REFRIGERATING APPARATUSES

DISCLOSURE OF THE INVENTION

This invention relates to a muffler for compressors, which compressors consist of an electric driving motor, a cylinder and a head for the cylinder in which are located the intake and compression chambers for the refrigerant gas. More particularly, the muffler is of a type already illustrated in an earlier filed U.S. application. The muffler is made of plastic material resistant to the chemical action of the refrigerant gas and the lubricating oil and driven into the upper part of the head.

An object of this invention is to provide a muffler structure which lowers the relevant production costs.

A muffler of the former type consists of a body and a cover welded to it. Therefore, two molds were required to mass produce the muffler.

The technical problem to be solved in order to eliminate this inconvenience and achieve the object of the invention was to find a special structure permitting one to obtain the economy wanted.

The solution of the technical problem is characterized by the fact that the unit consists of two overlapping half-shells of identical structure, assembled and turned by 180° to each other with their open walls in contact, a small tube on the upper half-shell in order to convey the refrigerant gas from the shell into the muffler, and a corresponding small tube on the lower half-shell capable of connecting the interior of the muffler with the intake chamber existing in the head.

Other details and features of the invention will stand out from the description given below by way of non-limitative example and with reference to the accompanying drawings, in which.

Figure 1:
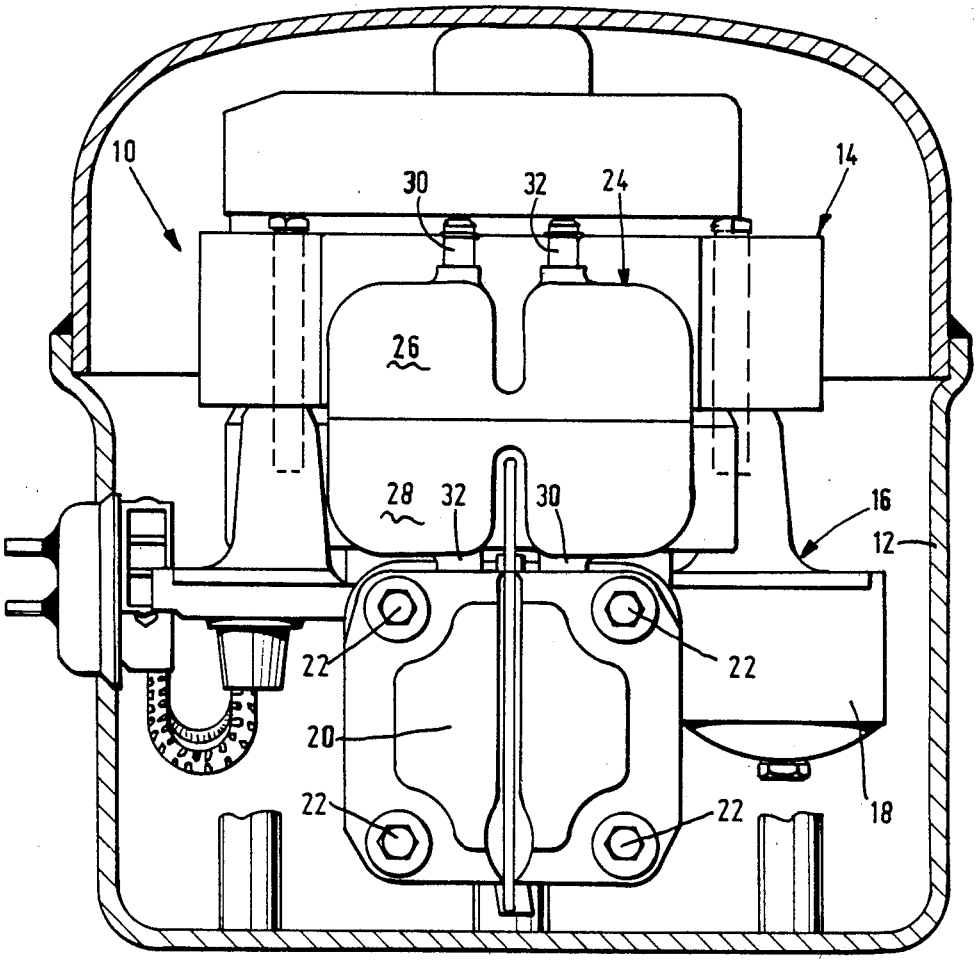
FIG. 1 shows a general view of a compressor.

With reference to FIG. 1 the compressor unit 10 is enclosed in the hermetically sealed shell 12, which contains the refrigerant gas. Compressor 10 consists of an electric motor 14, a body 16, and a muffler 18 on the delivery tube, obtained during the casting process in the body 16 itself.

Head 20 is connected by means of nuts 22 with the cylinder not shown in the figure.

Above the head is connected muffler 24, in a manner described in detail on the following pages.

Figure 2:
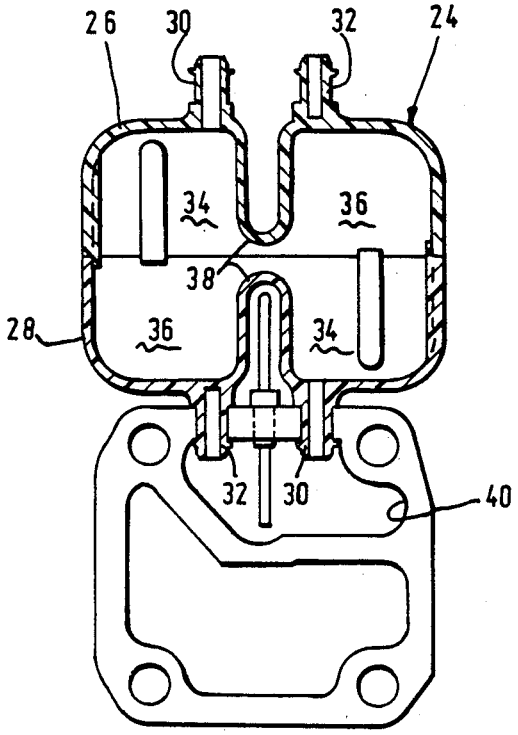
FIG. 2 shows a cutaway view of the muffler unit and the cylinder head of the compressor of FIG. 1.

With reference to FIG. 2, muffler 24 which is the object of this invention consists of an upper half-shell 26 and a lower half-shell 28.

In accordance with the idea of the invention, the half-shells have a similar structure and are preferably made of plastic material resistant to the chemical action of the refrigerant gas and the lubricating oil. Each half-shell has a parallelepiped shape with the base surface practically rectangular.

In the upper part of the half-shells there are two small tubes 30 and 32, the first of which is in communication with a first chamber 34, the second one is positioned above a second chamber 36, but not in communication with it.

The two chambers 34 and 36 are separated by a wall 38, which reaches almost to the open wall of each half-shell. The two half-shells are turned by 180° in respect to each other and welded together, so that through the open small tube 30 of the upper half-shell 26 the refrigerant gas passes from the hermetically sealed shell 12 of the compressor to the interior of muffler 24, in the space formed by chamber 34 of the upper half-shell 26 and the chamber 36 of the lower half-shell 28.

The refrigerant gas flows from chamber 34 to chamber 36 of the half-shell 26 through the narrow passage determined by the ends of the two walls 38 and from chamber 36 of the half-shell 26 to chamber 34 of the half-shell 28 and goes out through the open small tube 30 of the half shell 28 communicating with the intake chamber 40 of head 20 through a hole 42 existing on the upper wall of the head.

The small tube 32 of the half-shell 28 does not cooperate with the small tube 30 of the half-shell 26, when the two half-shells of the muffler 24 are rotated around their vertical axis of symmetry.

What is claimed is:

1. A muffler for compressors which compressors consist of a hermetically sealed shell, a driving electric motor, a cylinder, and a head for said cylinder in which are located the intake and compression chambers of the refrigerant gas, said muffler consisting of two overlapping half-shells of identical structure, assembled by bringing their open walls together and rotating one half-shell 180° with respect to the other, each half-shell defining two extensions therefrom, one of said extensions in each half-shell defining a conduit therethrough communicating with the interior of said half-shell, said extension with conduit located on the upper half-shell conveying the refrigerant gas from the hermetically sealed shell into the muffler and the extension with conduit on the lower half-shell communicating the interior of said muffler with the intake chamber located in said head.

2. The muffler according to claim 1, wherein said half-shells are made of plastic material resistant to the chemical action of the refrigerant gas and the lubricating oil.

* * * * *